US008033547B1

(12) United States Patent
Bryce

(10) Patent No.: US 8,033,547 B1
(45) Date of Patent: Oct. 11, 2011

(54) DIE STRUCTURE

(75) Inventor: Dan Bryce, Lake Geneva, WI (US)

(73) Assignee: Funderbolt Studios Inc., Springville, NY (US)

( * ) Notice: Subject to any disclaimer, the term of this patent is extended or adjusted under 35 U.S.C. 154(b) by 193 days.

(21) Appl. No.: 12/614,042

(22) Filed: Nov. 6, 2009

(51) Int. Cl.
*A63F 9/04* (2006.01)
*A63F 5/04* (2006.01)

(52) U.S. Cl. ..... 273/146; 273/288; 273/289; 273/142 R; 273/142 J; 273/142 JC; D21/372; D21/374; D21/386

(58) Field of Classification Search ..... 273/146, 273/288, 289, 142 R, 142 J, 142 JC; D21/372, D21/374, 386
See application file for complete search history.

(56) References Cited

U.S. PATENT DOCUMENTS

| | | | | |
|---|---|---|---|---|
| 973,595 | A | 10/1910 | Wahlin | |
| 3,198,522 | A * | 8/1965 | Parks | 273/142 R |
| 3,258,268 | A | 6/1966 | Treinis | |
| 3,400,932 | A | 9/1968 | Conrad | |
| 3,467,382 | A * | 9/1969 | Leadley | 273/148 R |
| 3,954,269 | A | 5/1976 | Brittingham | |
| 4,083,564 | A * | 4/1978 | Matsumoto | 273/239 |
| 4,257,611 | A * | 3/1981 | Schmitz, Sr. | 273/293 |
| 4,546,978 | A | 10/1985 | David | |
| 4,643,680 | A | 2/1987 | Hill | |
| 4,678,191 | A | 7/1987 | Mills et al. | |
| 4,776,802 | A | 10/1988 | Rind et al. | |
| 4,852,885 | A | 8/1989 | Baratpour et al. | |
| 4,874,175 | A | 10/1989 | Fischer | |
| 5,018,738 | A | 5/1991 | Padi | |
| 6,517,070 | B1 * | 2/2003 | Clapera | 273/148 A |
| 2008/0076526 | A1 | 3/2008 | Zhang | |
| 2008/0268942 | A1 | 10/2008 | DeRuyter | |

FOREIGN PATENT DOCUMENTS

| | | |
|---|---|---|
| DE | 202005001858 | 12/2005 |
| GB | 2144999 | 3/1985 |
| GB | 2334220 | 8/1999 |

* cited by examiner

*Primary Examiner* — Benjamin Layno
(74) *Attorney, Agent, or Firm* — Adam K Sacharoff; Much Shelist

(57) ABSTRACT

In one of the die structures provided herein, there includes first and second housing structures defined to secure to each other to form a plurality of sides. An internal wheel is provided with an aperture for receiving a peg extending from the first housing structure, such that the internal wheel is rotatably secured thereto. The internal wheel has a perimeter edge defined with spaced apart curved grooves positioned on the periphery thereof. A portion of the perimeter edge is accessible through the first housing structure. Lastly, there is a plurality of labels having indicia printed thereon and separately affixed to the plurality of sides. One of the plurality of labels is defined as an internal wheel label affixed to the internal wheel such that the indicia is visible through a window defined on the first housing structure.

14 Claims, 15 Drawing Sheets

DIE STRUCTURE

FIELD OF THE INVENTION

The present invention relates to die and die structure.

BACKGROUND ART

While die are well known and well developed there is always a continual need for improvements. The present invention improves upon the typical dice structure by adding features that can be used to enhance the enjoyment and increase the game play and activities available with the use of the improved dice structure.

SUMMARY OF THE INVENTION

In accordance with one embodiment of the present invention, there is provided a die structure for a child's game or the like. The die includes a housing, an internal wheel, and a plurality of labels positioned around the housing. The housing has first and second housing structures defined to secure to each other to form a plurality of sides, including a front side, a rear side and at least one intermediate side connected between the front and rear sides. The first housing structure further includes a peg extending inwardly towards an internal region of the housing.

The internal wheel has an aperture sized to receive the peg such that the internal wheel is rotatably secured to the first housing structure. The internal wheel further has a perimeter edge defined with a plurality of spaced apart curved grooves positioned on the periphery thereof. A portion of the perimeter edge is accessible through the first housing structure.

The plurality of labels have indicia printed thereon and separately affixes to the plurality of sides of the housing. One of the plurality of labels is defined as an internal wheel label affixed to a side of the internal wheel defined to face the first hosing structure, such that the indicia printed on the internal wheel label is visible through a window defined on the first housing structure.

The die structure further includes a latch with a locking member secured within the housing. The latch is biased such that when the internal wheel rotates, the locking member slides into and out of engagement with the curved grooves. Therefore, when the locking member is engaging a curved groove, the internal wheel maintains its position.

As previously mentioned, access through the first housing structure to the perimeter edge of the internal wheel may be given through a curved notch portion defined on the first housing structure.

In another embodiment of the present invention, the die structure can include a housing, external face, and a plurality of labels. The housing is defined to have first and second housing structures defined to secure to each other to form a plurality of sides, including a front side, a rear side and at least one intermediate side connected between the front and rear sides. The external face rotatably secures to the front side of the housing. A plurality of labels have indicia printed thereon and separately affixed to the plurality of sides of the housing, wherein one of the plurality of labels being defined as an external label affixed to the front side of the housing intermediate of the front side and the external face, such that the indicia printed on the external label is visible through a window defined on the external face.

The die structure may further include an opening on the front side of the housing to permit the passage of the ballast ball and the window on the external face being similarly sized to the opening, such that when the external face is rotated to align the opening and the window the ballast ball is capable of being removed from the die structure.

To rotatably secure the external face to the housing, the external face may include a central peg extending towards and through a central opening defined on the housing. The peg being secured to a gear positioned within the housing to capture the external rotating face against the front side of the housing. The gear having a plurality of notches sized to receive the end of a latch to permit rotation of the external face to various positions.

In other aspects, the external face has a shape sized to fit within a recessed section defined by the front side of the housing and the external face includes a plurality of protruding or recessed knobs positioned on the external face.

In addition, the die structure housing for any of the embodiments includes an intermediate side that may be defined to include a plurality of angled sections, each angled section defining a pair of adjacent side faces, such that the housing defines at least one of the following shapes, a hexagon, octagon, or decagon. In other aspects, the die structure may include an internal ballast ball enclosed within the housing and capable of freely moving within the housing.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE INVENTION

Figure 1A:
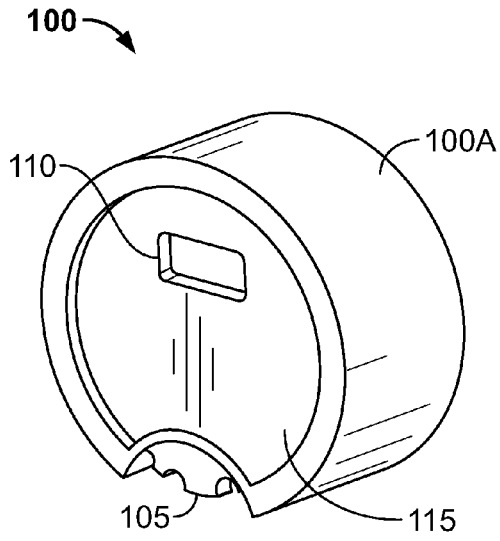
FIGS. 1A-1D are perspective front views of a first embodiment of a die structure with a rotating internal wheel and illustrating different shapes of the die structure.
Figure 1B:
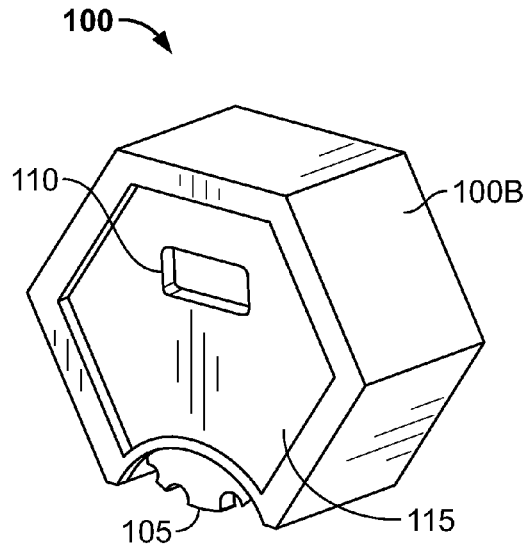
Figure 1C:
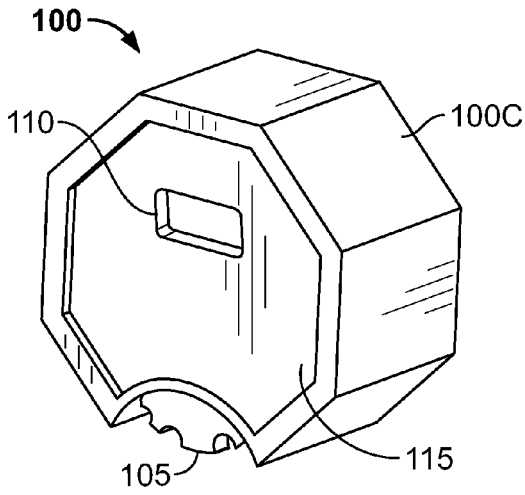
Figure 1D:
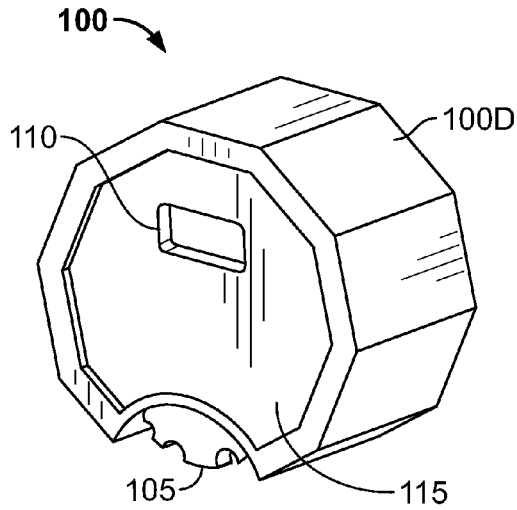
Figure 2:
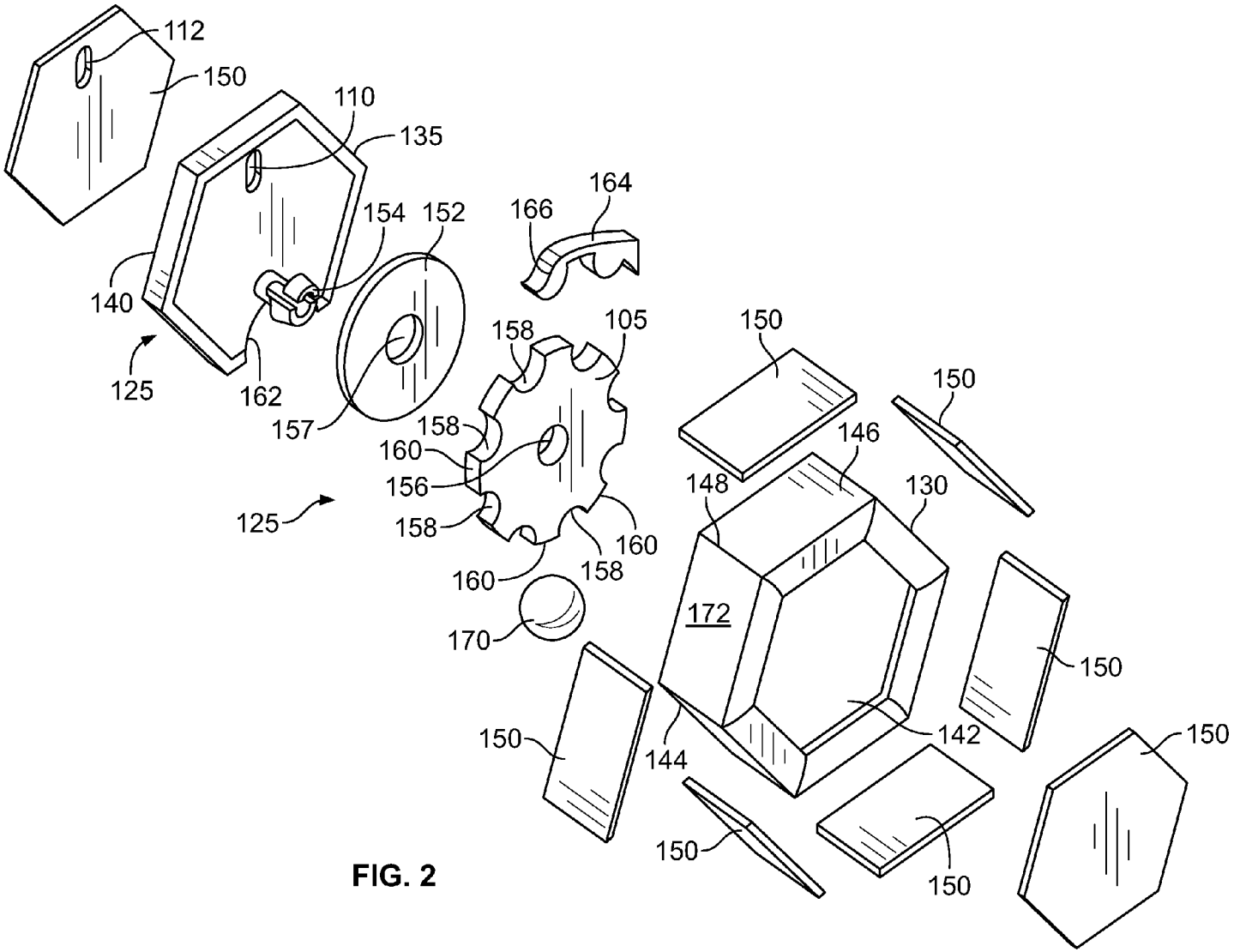
FIG. 2 is an exploded view of a die structure in accordance with a first embodiment of the present invention.
Figure 3B:
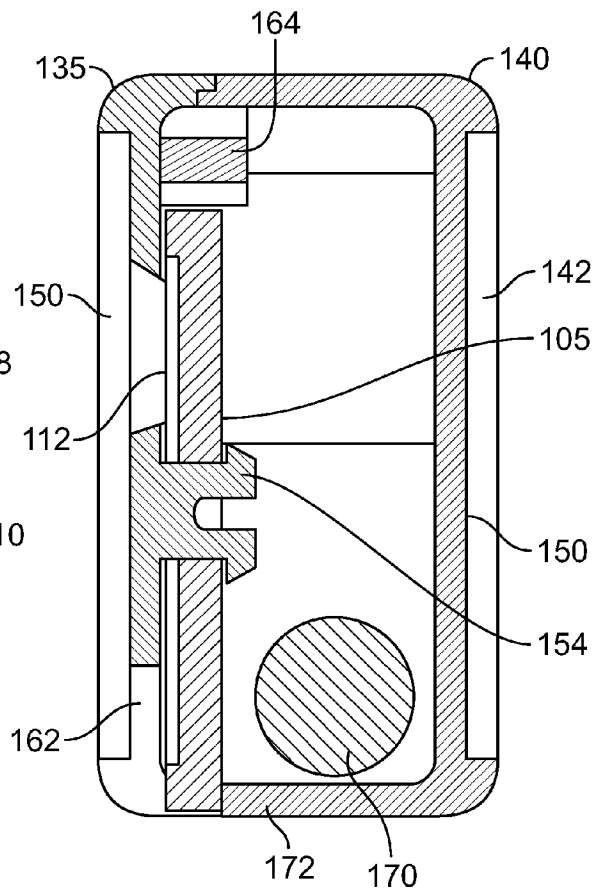
FIG. 3B is a cross sectional view taken across line 3B from FIG. 3A.
Figure 3A:
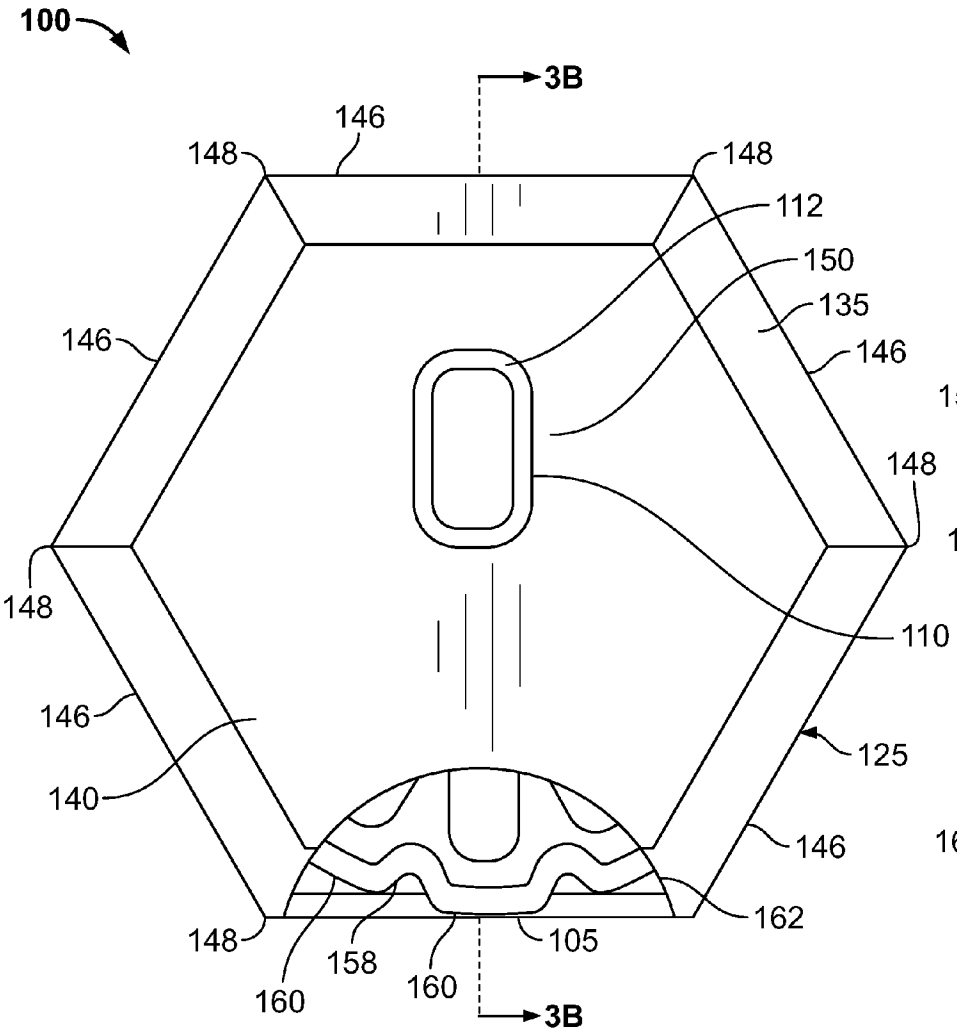
FIG. 3A is a front view of the die structure in accordance with a first embodiment of the present invention.
Figure 4A:
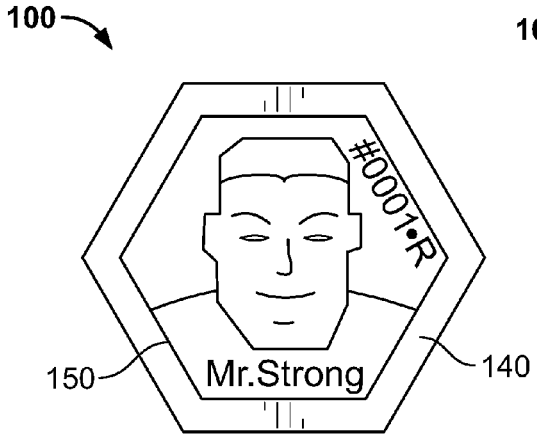
FIG. 4A is a rear view of the die structure in accordance with a first embodiment of the present invention.
Figure 4B:
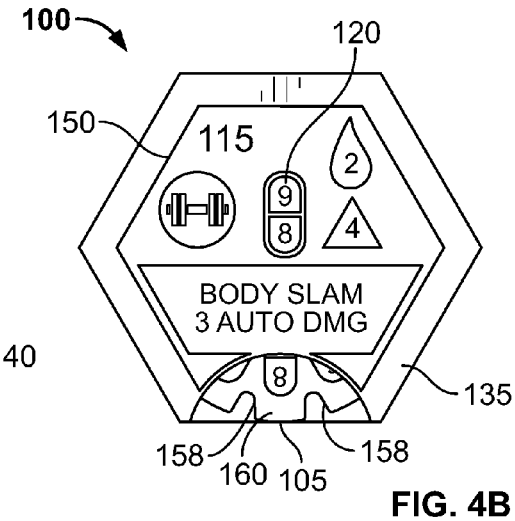
FIG. 4B is a front view of the die structure in accordance with a first embodiment of the present invention.
Figure 4C:
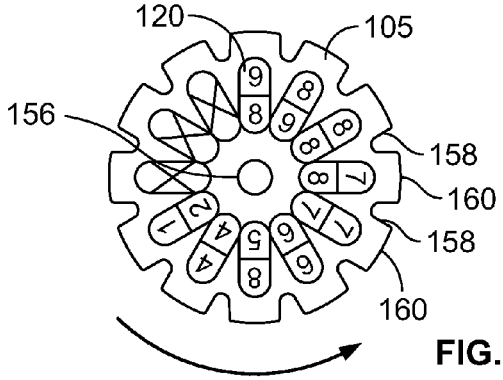
FIG. 4C is a front view of an internal wheel of the die structure in accordance with a first embodiment of the present invention.
Figure 4D:
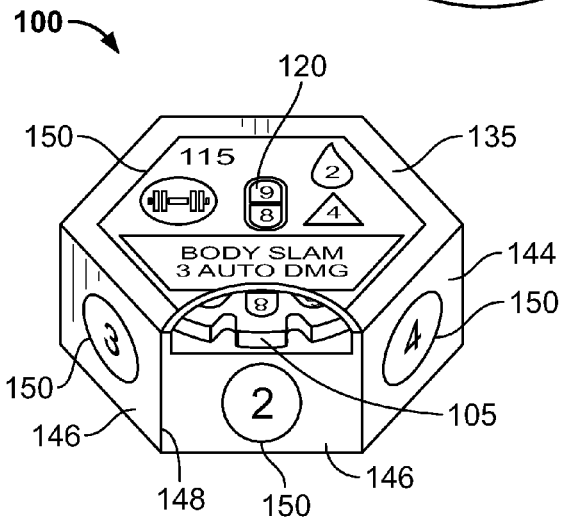
FIG. 4D is a side front perspective view of the die structure in accordance with a first embodiment of the present invention.
Figure 4E:
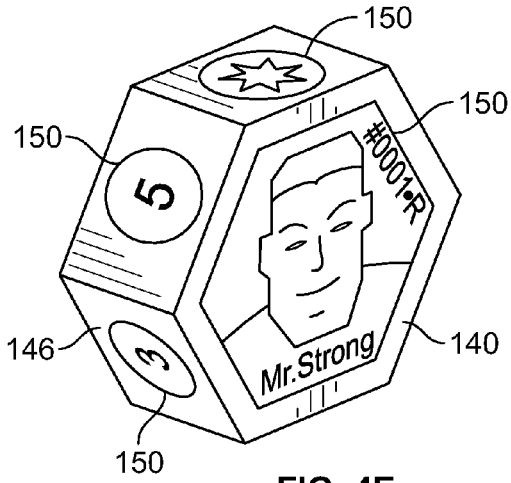
FIG. 4E is a side rear perspective view of the die structure in accordance with a first embodiment of the present invention.
Figure 5A:
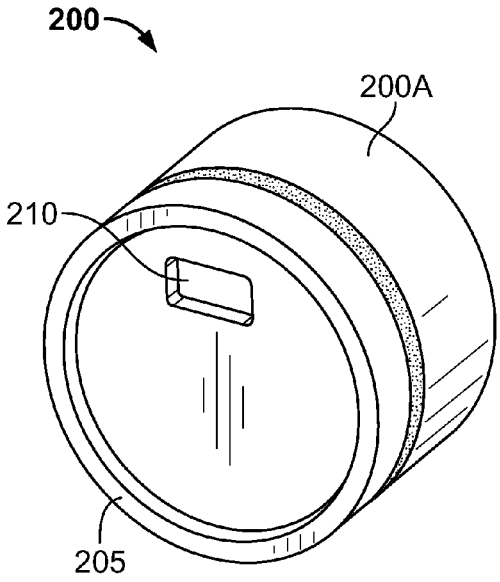
FIGS. 5A-5D are perspective views of a second embodiment of a die structure with a rotating external face and illustrating different shapes of the die structure.
Figure 5B:
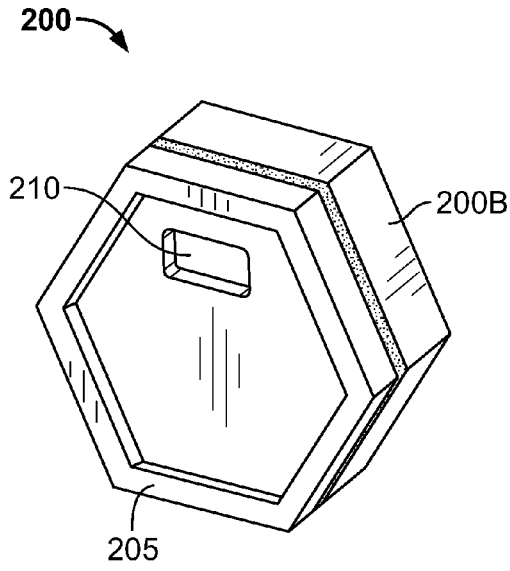
Figure 5C:
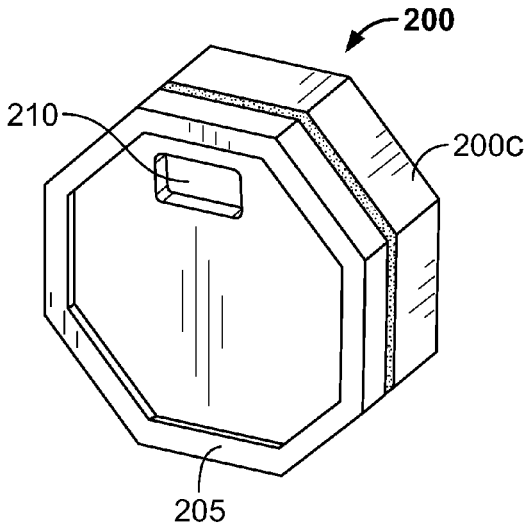
Figure 5D:
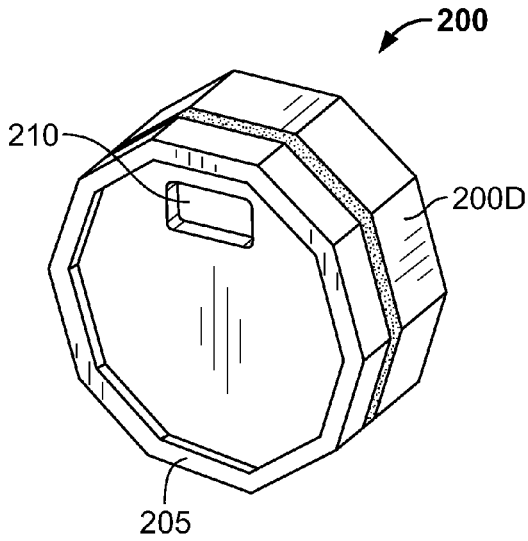
Figure 6:
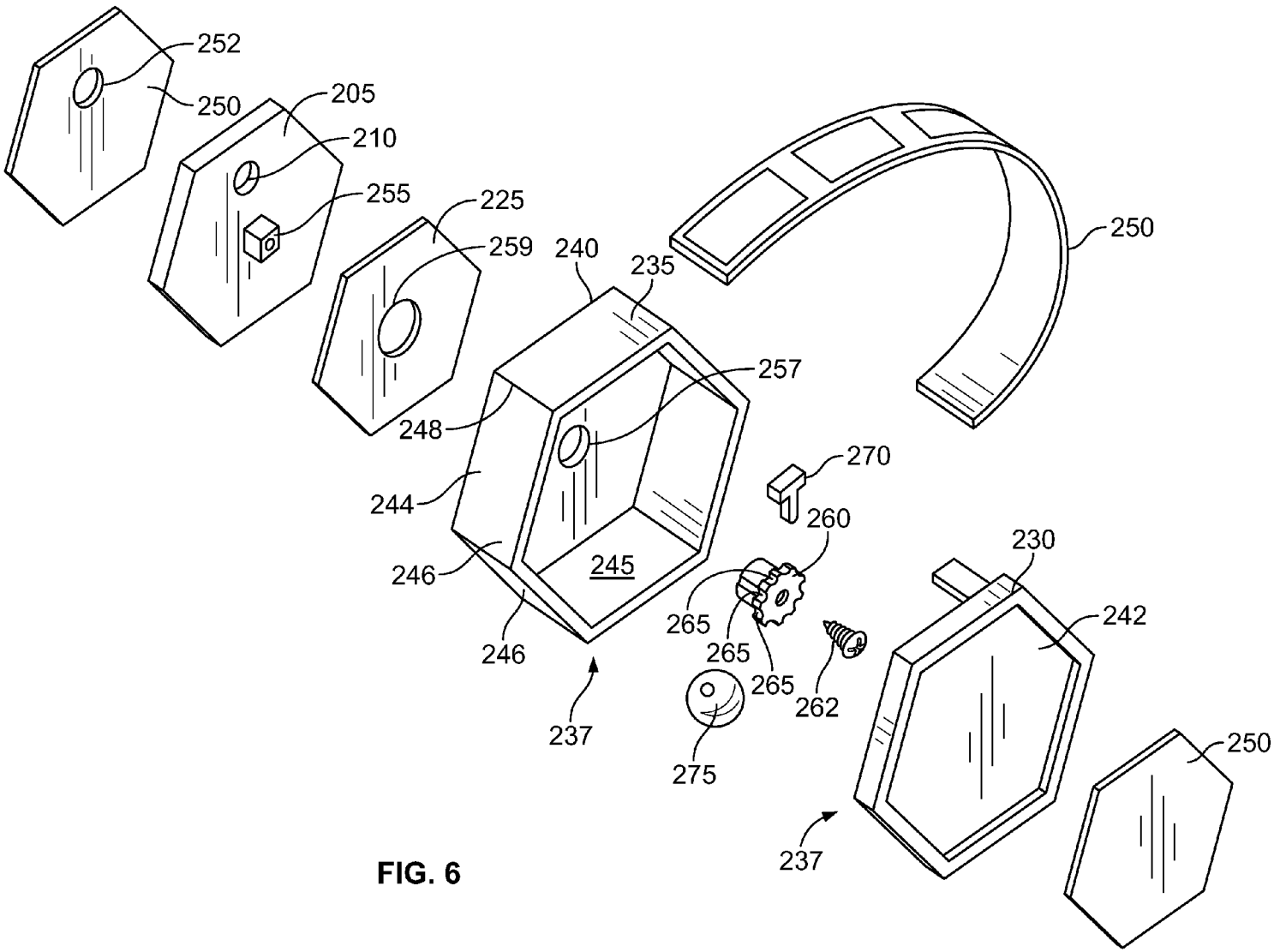
FIG. 6 is an exploded view of a die structure in accordance with the second embodiment of the present invention.
Figure 7B:
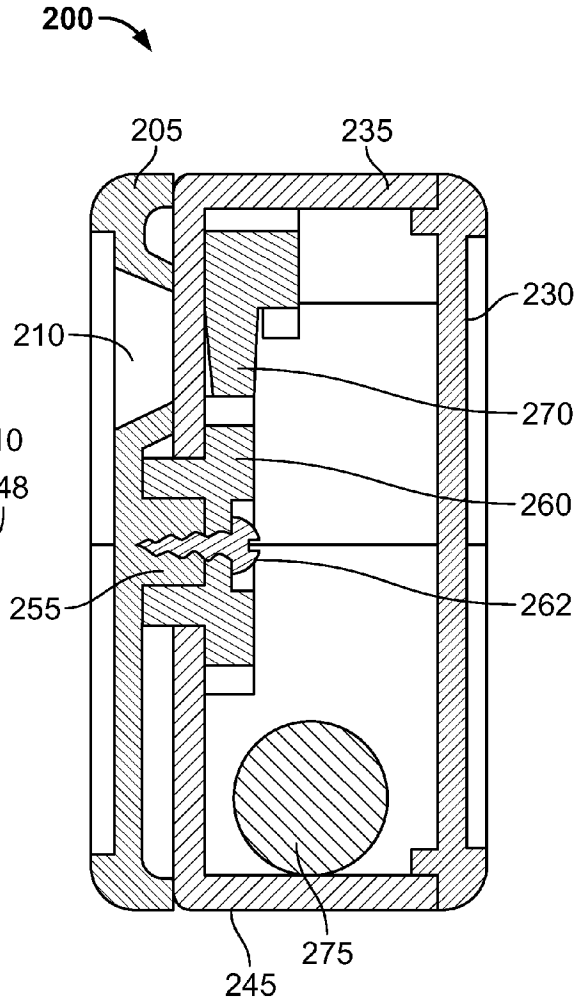
FIG. 7B is a cross sectional view taken across line 7B from FIG. 7A.
Figure 7A:
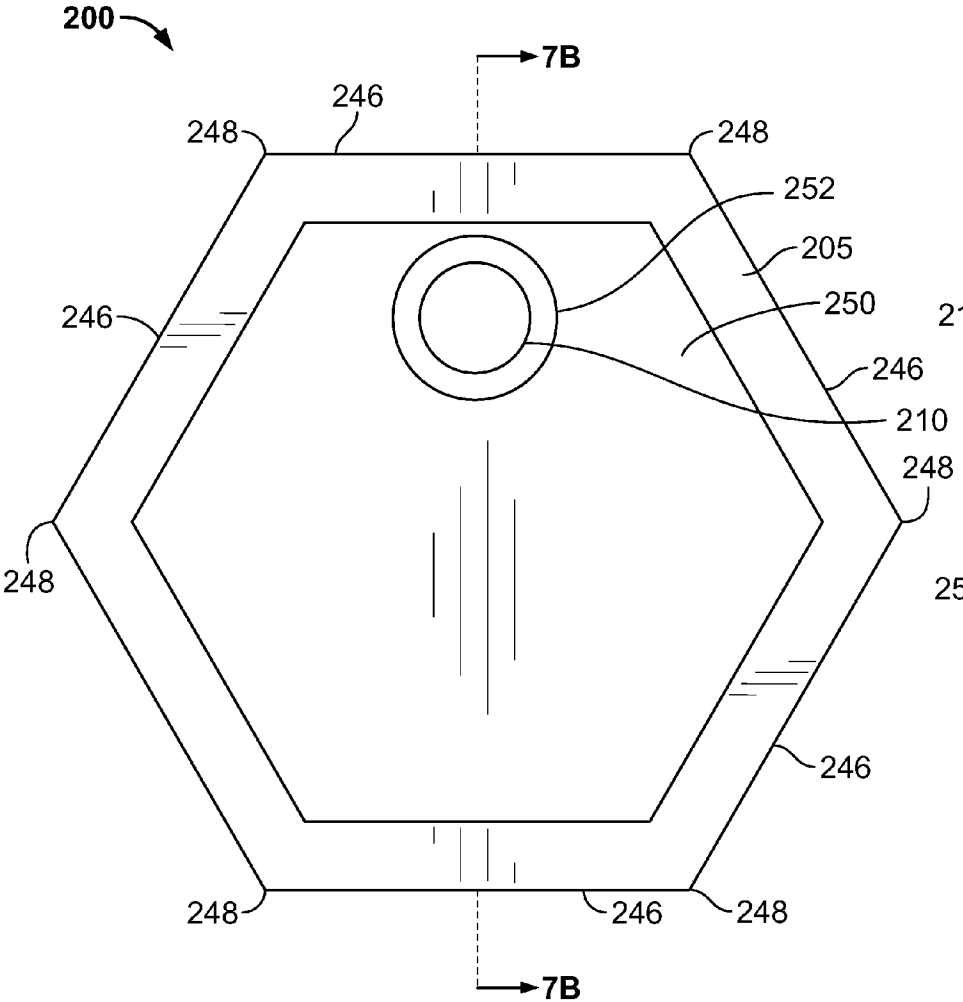
FIG. 7A is a front view of the die structure in accordance with the second embodiment of the present invention.
Figure 8A:
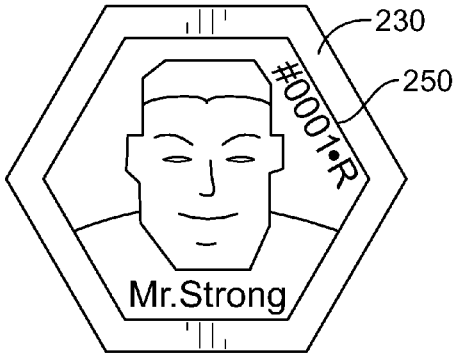
FIG. 8A is a rear view of the die structure in accordance with the second embodiment.
Figure 8B:
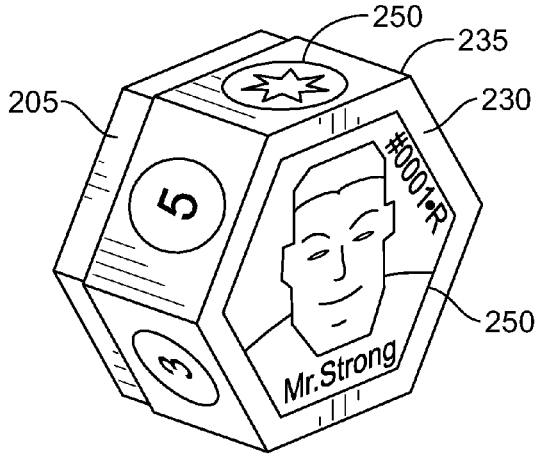
FIG. 8B is a rear perspective view of the die structure in accordance with the second embodiment.
Figure 8C:
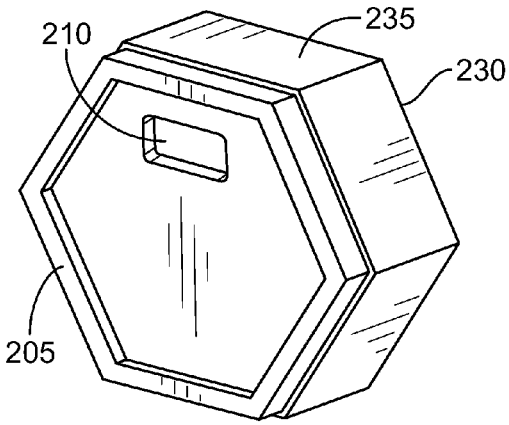
FIG. 8C is a front perspective view of the die structure in accordance with the second embodiment.
Figure 8D:
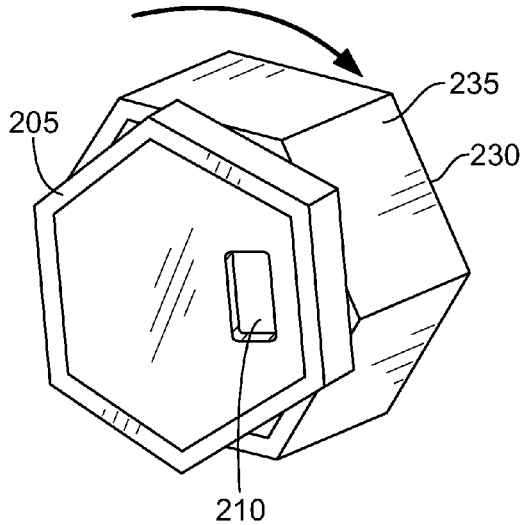
FIG. 8D is a front perspective view illustrating the rotating of the external face of the die structure in accordance with the second embodiment.
Figure 8G:
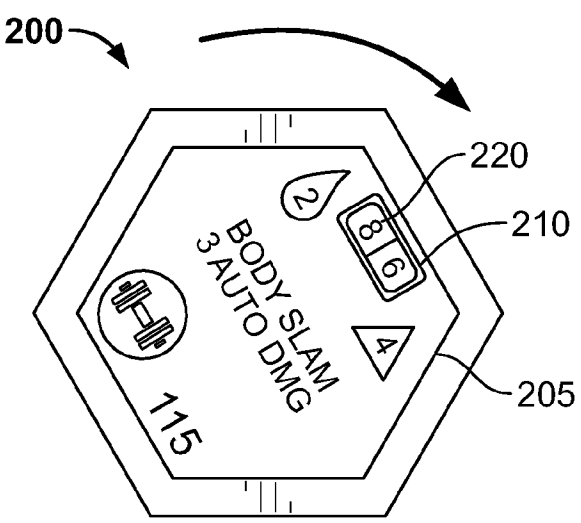
FIG. 8G is a front view of the second embodiment illustrating the rotation of the external face.
Figure 8F:
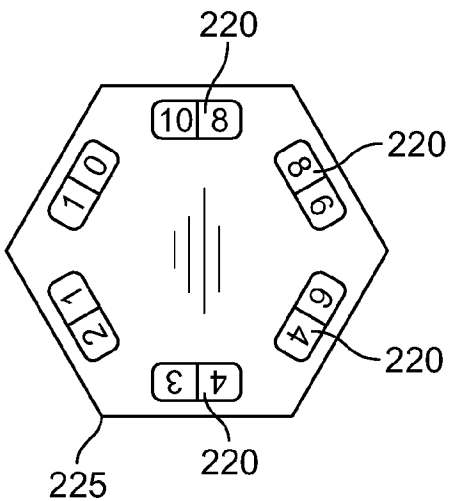
FIG. 8F is a view of the label used on the face of the front housing for the second embodiment.
Figure 8E:
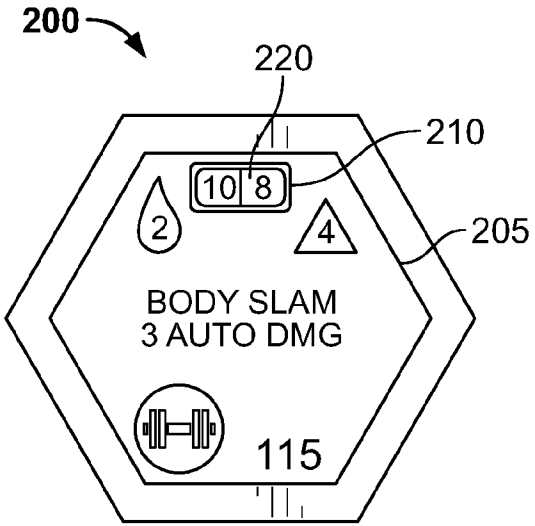
FIG. 8E is a front view of the die structure in accordance with the second embodiment.
Figure 9C:
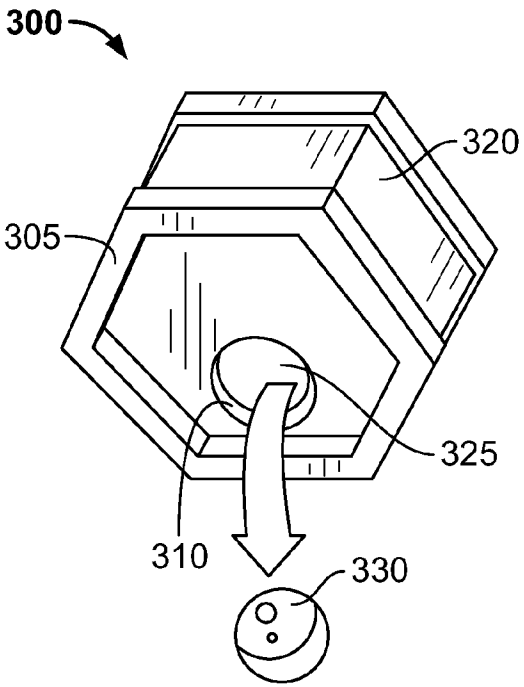
FIG. 9C is perspective view of a third embodiment of a die structure with a rotating external face illustrating the rotation of the external face and alignment of opening to removing the ballast ball.
Figure 9B:
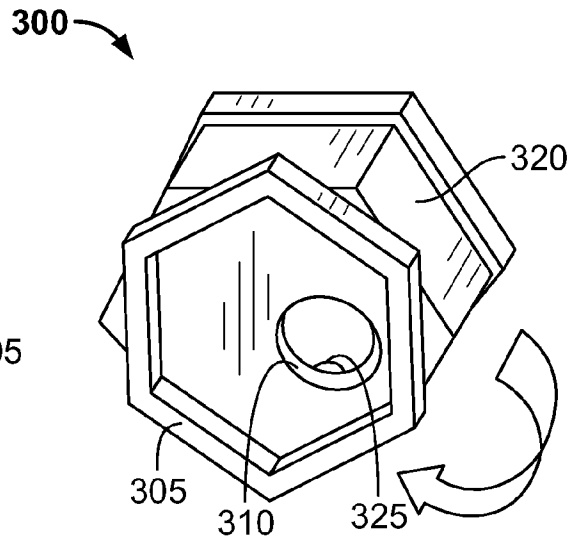
FIG. 9B is perspective view of a third embodiment of a die structure with a rotating external face illustrating the rotation of the external face.
Figure 9A:
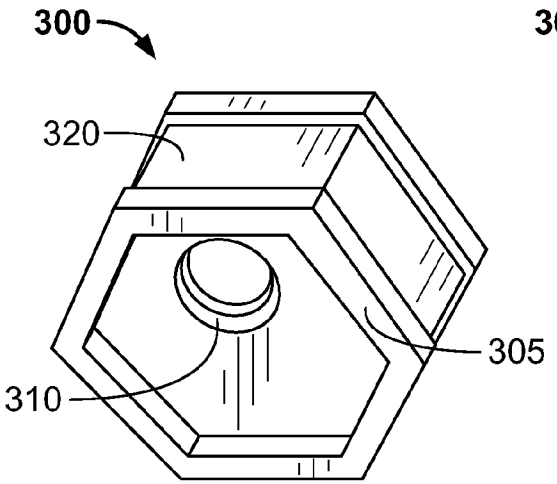
FIG. 9A is perspective view of a third embodiment of a die structure with a rotating external face and opening for removing a ballast ball.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or the embodiments illustrated.

Referring now to FIGS. 1A through 4E, there is shown in various first embodiments a die 100 and more particularly, die 100A through 100D illustrated through various shapes, for example, cylinder 100A, hexagon 100B, octagon 100C, and decagon 100D. Various other shapes may be included without changing the scope of the invention. As is well known functional die structures can have an even number of sides, all of which are easily incorporated into the present invention embodiments. As will be discussed greater hereinbelow, the die 100 incorporates a rotating internal wheel or disk 105 and a window 110 through the front face 115 of the die 100, which permits viewing of indicia 120 printed on a label 152 that is affixed to a side of the rotating internal wheel 105.

The die 100 includes first and second housing structures, 130 and 135 respectively. The housing structures secure together to form a die housing 125, which includes a number of sides, including a front side 140 (also referred to herein as a front face 115), rear side 142, and at least one intermediate side 144 between the front and rear sides. The intermediate side 144 may be broken into various side faces 146, if for example the intermediate side 144 includes an angled section 148. Each of the faces, includes a region to receive a printed label 150 that includes indicia or game play information.

As previously mentioned one or more of the sides and corresponding labels includes a window 110 (and label window 112) to view a printed indicia label 152 that is secured to the internal wheel 105. To rotatably secure the internal wheel 105 to the particular housing structure (illustrated as the second structures 135), the second structure 135 includes a peg 154 that inserts through an opening 156 on the internal wheel 105. The printed label 152 that is particularly affixed to the side of the rotating internal wheel 105 also includes an opening 157 such that the peg 154 may pass through the label 152.

The wheel 105 includes a plurality of curved grooves 158 positioned on the periphery thereof, leaving a perimeter edge 160 between each pair of curved grooves 158. The second structure 135 includes a curved notch 162 on a portion thereof, such that when the die 100 is assembled, the curved grooves 158 are exposed through the curved notch 160. This permits the user to rotate the wheel 105 by positioning a finger or fingernail in an exposed curved grooves 158 and moving the wheel 105 in a desired direction. While it is possible to have a freely rotating wheel, which may be used to randomize the indicia through the window, the present die 100 includes a wheel latch 164, having a locking member 166 that slides into a curved groove and keeps the wheel from moving on its own. The wheel latch 164 is pivotally secured to the die housing 125 such that preferably the wheel can rotate in either direction. In other embodiments, the latch 164 may be biased by a spring to ensure movement of the wheel 105 in only a single direction.

Since the shapes are slightly different from a normal die structure, the present first embodiments include a ballast ball 170 positioned within the housing 125 to help randomize the rotation and movement of the die when it is cast or thrown by the user. The ballast ball 170 also helps the die to standup on a narrow side, defined by the intermediate side 144 and further created by wall 172 extending from the first housing structure 130 towards the second housing structure 135. The ballast ball 170 will typically sit against the wall 172.

Turing now to FIGS. 4A through 4E, During game play, the faces of the die can contain various gaming information such that when the dice lands with the front face, rear face, or one of the side faces exposed upwardly different events may be triggered by the gaming information. Players may play against each other by rolling their own die(dice) and competing in a game play. Each round can be tracked by rotating the wheel such that a specific number or indicia is shown through the rear face window 110.

Referring now to FIGS. 5A through 8G there is shown in various second embodiments a die 200 and more particularly, die 200A through 200D illustrated through various shapes, for example, cylinder 200A, hexagon 200B, octagon 200C, and decagon 200D. Various other shapes may be included without changing the scope of the invention. As will be discussed greater hereinbelow, the die 200 incorporates a rotating external face 205, which includes a window 210 through which permits viewing of indicia 220 printed on a label 225.

The die 200 includes a two piece housing structure, a first housing structure 230 and a second housing structure 235 that secure together to form a die housing 237, which includes a number of sides, including a front side 240, rear side 242, and at least one intermediate side 244 between the front and rear sides. The intermediate side 244 may be broken into various side faces 246, if for example the intermediate side 244 includes an angled section 248. Each of the faces, includes a region to receive a printed label 250 that includes indicia or game play information. One of the labels 250 may include a window 252 to correspond with the window 210 in the rotating external face 205.

To secure the rotating external face 205 to the particular housing (illustrated as the second housing structure 235), the rotating external face 205 includes a peg 255 that extends towards the second housing structure 235 and inserts through an openings 257 on the second housing structure 235. The peg would also insert through an opening 259 on the label 225 that is placed on the front side 240. Secured to the peg 255, via a screw 262 is a gear 260 positioned within the second housing structure 235. The gear 260 includes various notches 265 used in concert with a latch 270. As the external face 205 is rotated, the gear 260 rotates to a position that corresponds with the latch 270 clicking into place in one of the notches 265 on the gear 260. Furthermore, when the external face 205 is rotated, the label 225 is fixed in place, such that the window 210 rotates around the label 225 to display different indicia.

Since the shapes are slightly different from a normal die structure, the present second embodiments include a ballast ball 275 positioned within the housing 237 to help randomize the rotation and movement of the die when it is cast or thrown by the user. The ballast ball 275 also helps the die to standup on a narrow side, defined by a side wall 245 extending from one of the housing structures (235 or 230) towards the other housing structure. The ballast ball 275 will typically sit against the side wall 245.

Turing now to FIGS. 8A through 8G, during game play, the faces of the die can contain various gaming information such that when the dice lands with the front face, rear face, or one of the side faces exposed upwardly different events may be triggered by the gaming information. Players may play against each other by rolling their own die(dice) and competing in a game play. Each round can be tracked by rotating the wheel such that a specific number or indicia is shown through the rear face window 210.

Figure 10B:
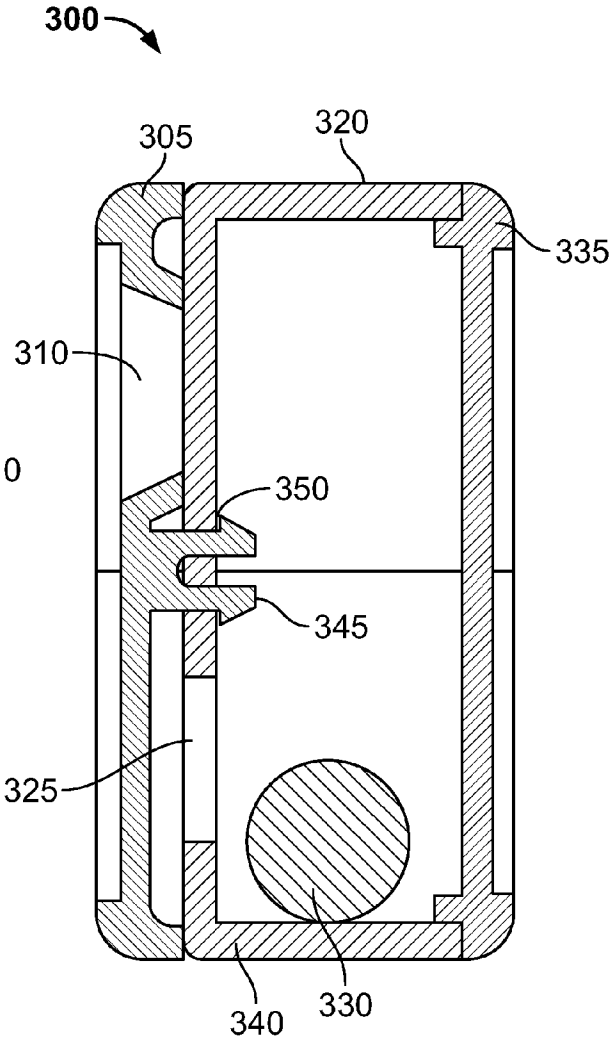
FIG. 10B is a cross sectional view taken across line 7B from FIG. 7A.
Figure 10A:
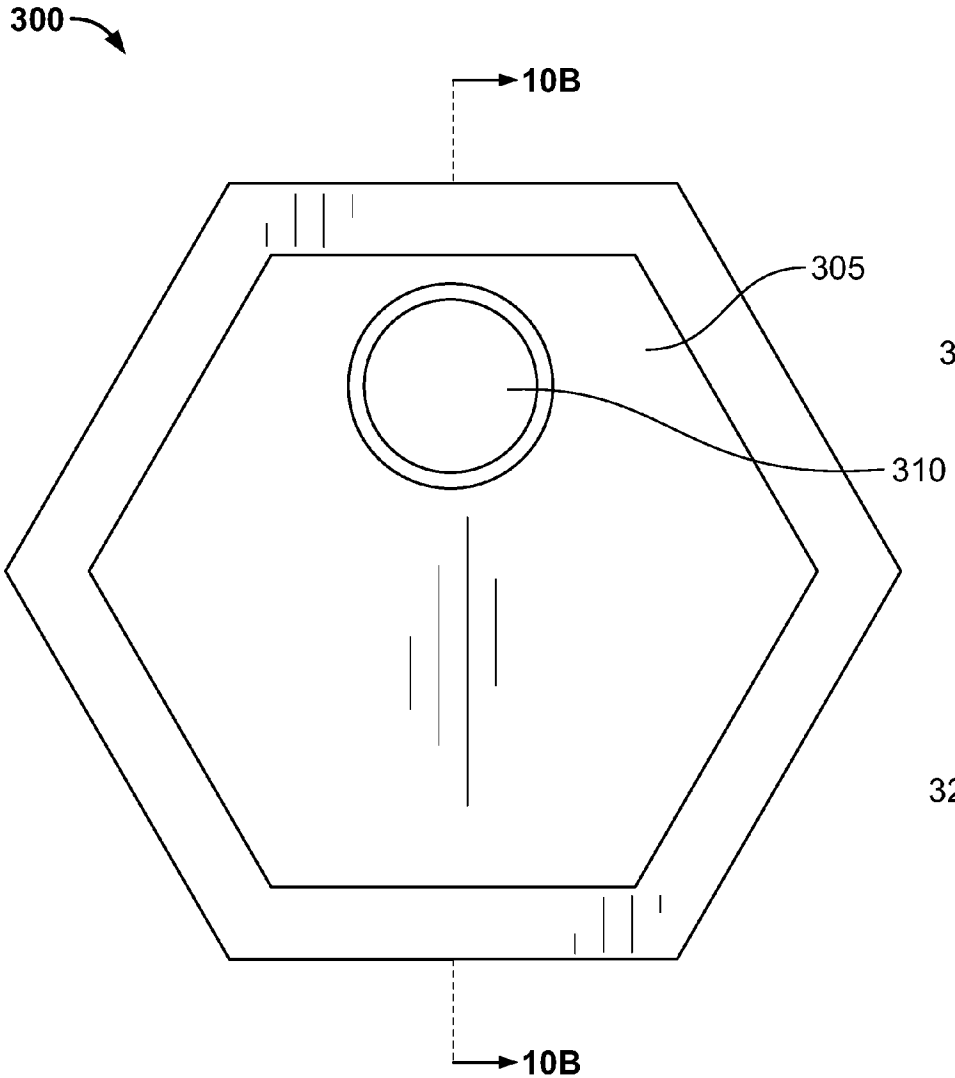
FIG. 10A is a front view of the die structure in accordance with the third embodiment.

Referring now to FIGS. 9A through 10B, there is shown a third embodiment die 300 which includes an external rotating face 305, similar to the second embodiments, except in that the external rotating face 305 includes an aperture 310 which is able to align with an opening 325 on the first housing structure 320, permitting the user to remove the ballast ball 330. This would permit the user to replace the ballast ball 330 with another ball, allowing for the die to be personalized. As shown in FIGS. 10A and 10B, the first housing structure 320 is secured to a second housing structure 335. One of the housing structures further includes a side 340 extending therefrom and permits a region for which the ballast ball 330 can move within the housing. The external rotating face 305 may further include a peg 345 aligned to rotatably fit into an opening 350 in a face of the first housing structure 320.

Figure 11:
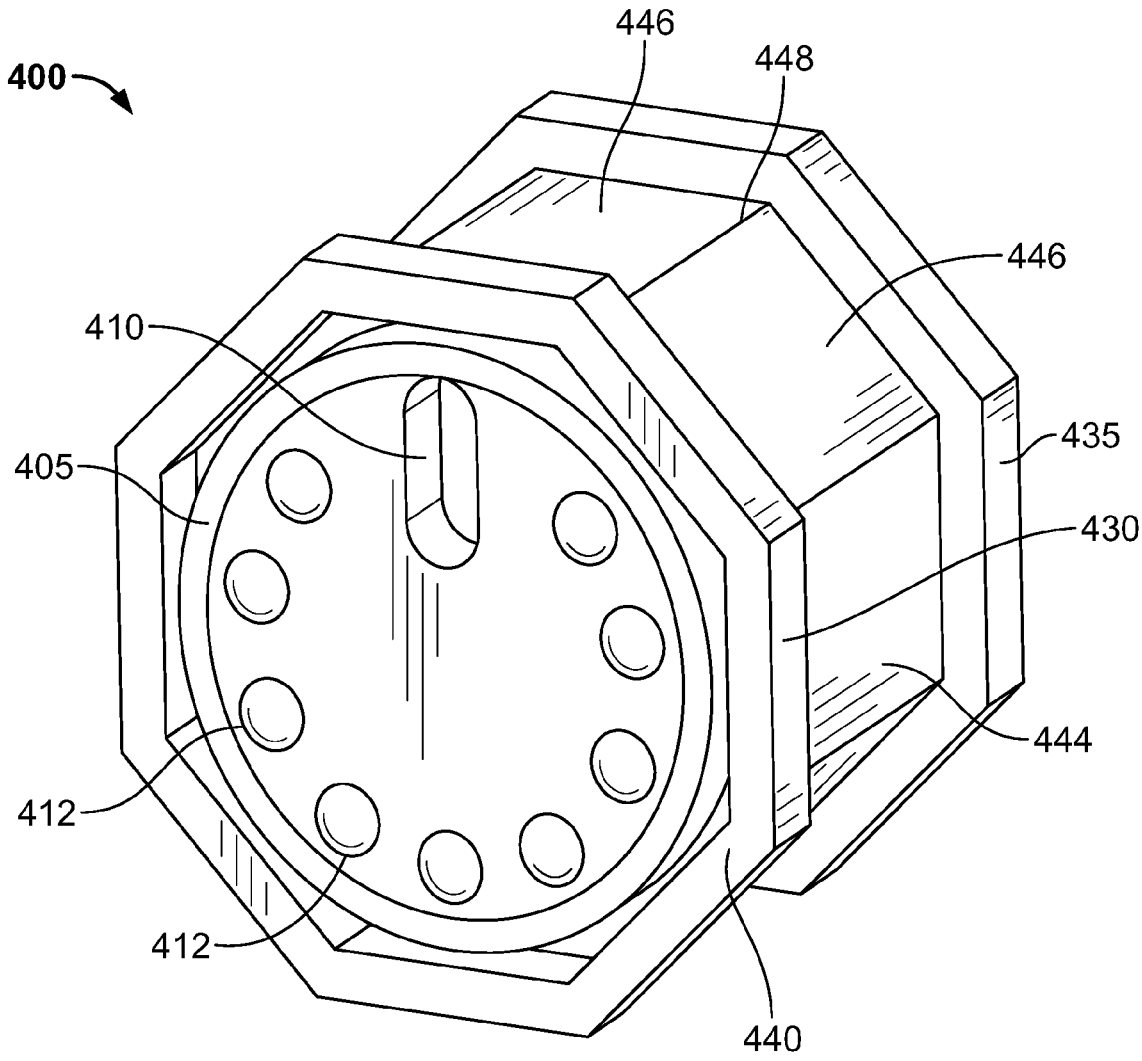
FIG. 11 is a perspective view of a fourth embodiment of the present invention of a die structure with a rotating external dial.
Figure 12B:
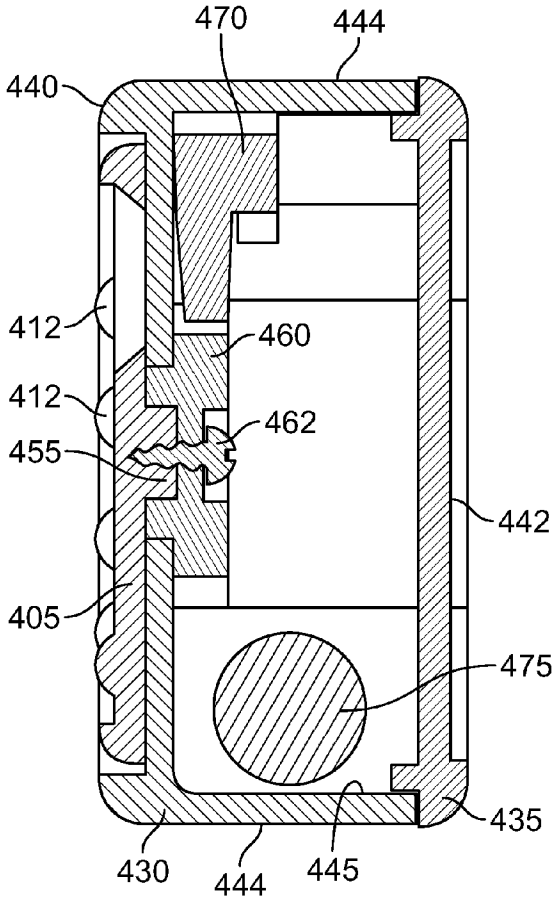
FIG. 12B is a cross section view taken across line 12B from FIG. 12A.
Figure 12A:
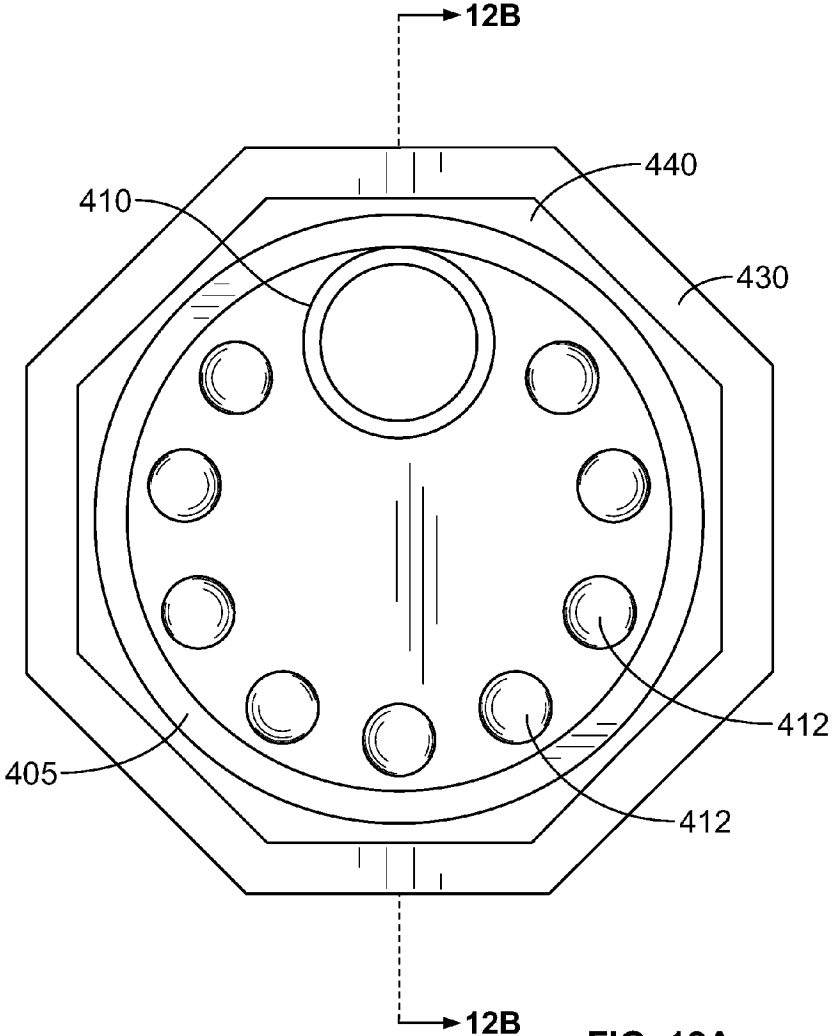
FIG. 12A is a front view of the fourth embodiment.
Figure 13:
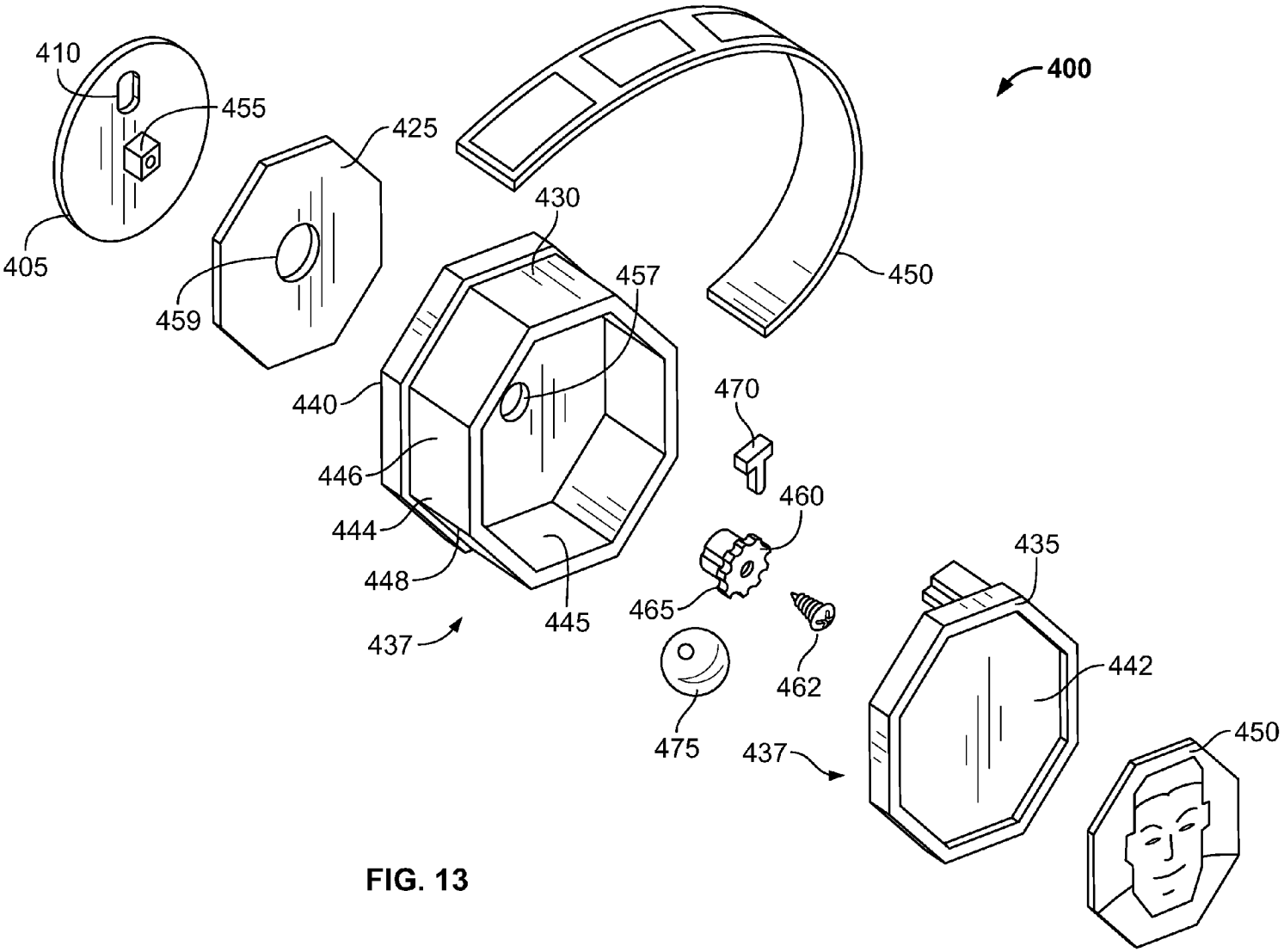
FIG. 13 is an exploded view of the fourth embodiment.
Figure 14C:
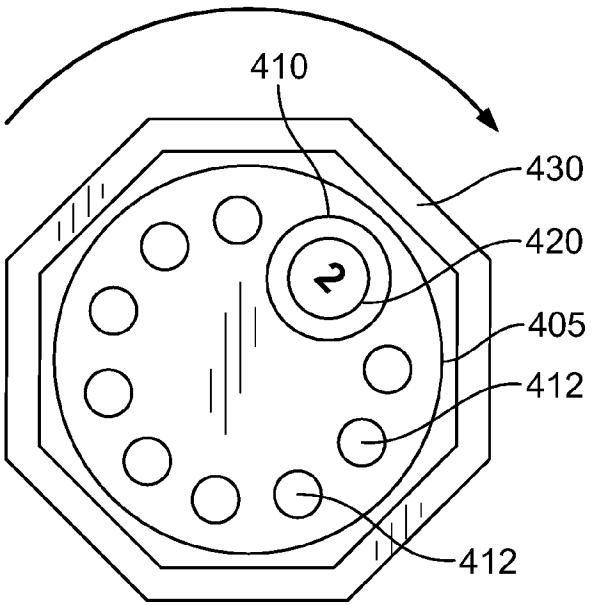
FIG. 14C is a front view of the die structure in accordance with the fourth embodiment, illustrating the rotation of the external rotating dial.
Figure 14B:
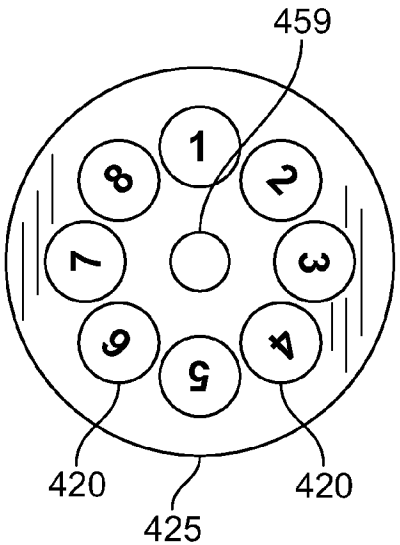
FIG. 14B is a view of a label having indicia visible through a window on the external rotating dial.
Figure 14A:
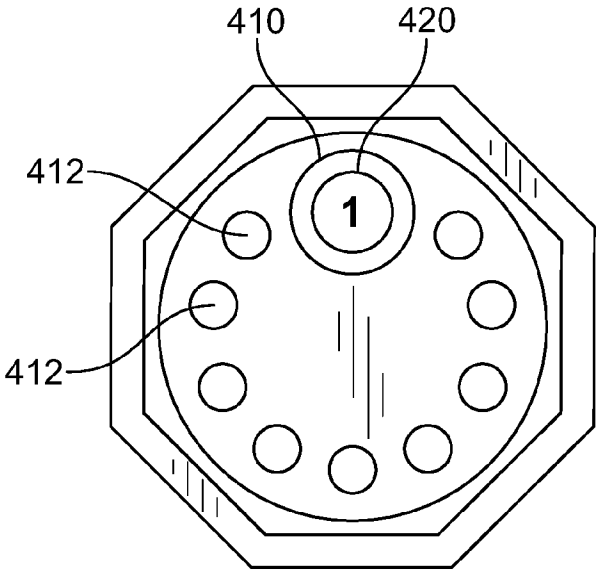
FIG. 14A is a front view of the die structure in accordance with the fourth embodiment.

Referring now to FIGS. 11 through 13 there is shown a fourth embodiment of a die 400. As will be discussed greater hereinbelow, the die 400 incorporates a rotating external face 405, which includes a window 410 through which permits viewing of indicia 420 printed on a label 425.

The die 400 includes a two piece housing structure, a first housing structure 430 and a second housing structure 435 that secure together to form a die housing 437, which includes a number of sides, including a front side 440, rear side 442, and at least one intermediate side 444 between the front and rear sides. The intermediate side 444 may be broken into various side faces 446, if for example the intermediate side 444 includes an angled section 448. Each of the faces, includes a region to receive a printed label 450 that includes indicia or game play information.

To secure the rotating external face 405 to the particular housing (illustrated as the first housing structure 430), the rotating external face 405 includes a peg 455 that extends towards the first housing structure 430 and inserts through an openings 457 on the first housing structure 430. The peg would also insert through an opening 459 on the label 425 that is placed on the front side 440. Secured to the peg 455, via a screw 462 is a gear 460 positioned within the first housing structure 430. The gear 460 includes various notches 465 used in concert with a latch 470. As the external face 405 is rotated, the gear 460 rotates to a position that corresponds with the latch 470 clicking into place in one of the notches 465 on the gear 460. Furthermore, when the external face 405 is rotated, the label 425 is fixed in place, such that the window 410 rotates around the label 455 to display different indicia.

In this embodiment, the external face 405 is similar to a dial positioned on the outside of the housing structure. To rotate the external face 405 a number of protruding or recessed knobs 412 are positioned around the perimeter of the face 405. The user can grip the protruding knob or rest a finger into the recessed knob and rotate the face.

Since the shapes are slightly different from a normal die structure, the present second embodiments include a ballast ball 475 positioned within the housing 437 to help randomize the rotation and movement of the die when it is cast or thrown by the user. The ballast ball 475 also helps the die to standup on a narrow side, defined by a side wall 445 extending from one of the housing structures (435 or 430) towards the other housing structure. The ballast ball 475 will typically sit against the side wall 445.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred.

I claim:

1. A die structure for a child's game or the like comprising:

a housing having first and second housing structures defined to secure to each other to form a plurality of sides, including a front side, a rear side and at least one intermediate side connected between the front and rear sides, the first housing structure including a peg extending inwardly towards an internal region of the housing;

an internal wheel having an aperture for receiving the peg such that the internal wheel is rotatably secured to the first housing structure, the internal wheel further having a perimeter edge, the perimeter edge further defined with a plurality of spaced apart curved grooves positioned on the periphery thereof, and wherein a portion of the perimeter edge being accessible through the first housing structure; and a plurality of labels having indicia printed thereon and separately affixed to the plurality of sides of the housing, wherein one of the plurality of labels being defined as an internal wheel label affixed to a side of the internal wheel defined to face the first hosing structure, such that the indicia printed on the internal wheel label is visible through a window defined on the first housing structure.

2. The die structure of claim 1 further comprising a latch with a locking member secured within the housing, the latch being biased such that when the internal wheel rotates, the locking member slides into and out of engagement with the curved grooves, wherein when the locking member is engaging a curved groove, the internal wheel maintains its position.

3. The die structure of claim 1 further comprising an internal ballast ball enclosed within the housing and capable of freely moving within the housing.

4. The die structure of claim 1, wherein the first housing structure further includes a curved notch portion to permit access to the perimeter edge of the internal wheel.

5. The die structure of claim 1, wherein the intermediate side further has defined a plurality of angled sections, each angled section defining a pair of adjacent side faces, such that the housing defines at least one of the following shapes, a hexagon, octagon, or decagon.

6. A die structure for a child's game or the like comprising:

a housing having first and second housing structures defined to secure to each other to form a plurality of sides, including a front side, a rear side and at least one intermediate side connected between the front and rear sides, the first housing structure including a peg extending inwardly towards an internal region of the housing;

an internal wheel having an aperture for receiving the peg such that the internal wheel is rotatably secured to the first housing structure, the internal wheel further having a perimeter edge, the perimeter edge further defined with a plurality of spaced apart curved grooves positioned on the periphery thereof, and wherein a portion of the perimeter edge being accessible through the first housing structure;

and the first housing structure further including a curved notch portion to permit access to the perimeter edge of the internal wheel;

a latch with a locking member secured within the housing, the latch being biased such that when the internal wheel rotates, the locking member slides into and out of engagement with the curved grooves, wherein when the locking member is engaging a curved groove, the internal wheel maintains its position;

an internal ballast ball enclosed within the housing and capable of freely moving within the housing; and a plurality of labels having indicia printed thereon and separately affixed to the plurality of sides of the housing, wherein one of the plurality of labels being defined as an internal wheel label affixed to a side of the internal wheel defined to face the first hosing structure, such that the indicia printed on the internal wheel label is visible through a window defined on the first housing structure.

7. The die structure of claim 6, wherein the intermediate side further has defined a plurality of angled sections, each angled section defining a pair of adjacent side faces, such that the housing defines at least one of the following shapes, a hexagon, octagon, or decagon.

8. A die structure for a child's game or the like comprising:

a housing having first and second housing structures defined to secure to each other to form a plurality of sides, including a front side, a rear side and at least one intermediate side connected between the front and rear sides;

an external face being rotatably secured to the front side of the housing; and a plurality of labels having indicia printed thereon and separately affixed to the plurality of sides of the housing, wherein one of the plurality of labels being defined as an external label affixed to the front side of the housing intermediate of the front side and the external face, such that the indicia printed on the external label is visible through a window defined on the external face.

9. The die structure of claim 8, wherein the intermediate side further has defined a plurality of angled sections, each angled section defining a pair of adjacent side faces, such that the housing defines at least one of the following shapes, a hexagon, octagon, or decagon.

10. The die structure of claim 8 further comprising an internal ballast ball enclosed within the housing and capable of freely moving within the housing.

11. The die structure of claim 10 wherein the front side of the housing has an opening sized to permit the passage of the ballast ball and the window on the external face is similarly sized to the opening, such that when the external face is rotated to align the opening and the window the ballast ball is capable of being removed from the die structure.

12. The die structure of claim 11, wherein the external face includes a central peg extending towards and through a central opening defined on the housing and the peg is secured to a gear positioned within the housing to capture the external rotating face against the front side of the housing, the gear having a plurality of notches sized to receive the end of a latch to permit rotation of the external face to various positions.

13. The die structure of claim 8, wherein the external face has a shape sized to fit within a recessed section defined by the front side of the housing.

14. The die structure of claim 13, wherein the external face includes a plurality of protruding or recessed knobs positioned on the external face.

* * * * *